US007240979B2

(12) United States Patent
Chiu

(10) Patent No.: US 7,240,979 B2
(45) Date of Patent: Jul. 10, 2007

(54) STRUCTURE OF ADJUSTABLE SLIDING DEVICE

(75) Inventor: I Hsiang Chiu, Taipei (TW)

(73) Assignee: Nan Juen International Co., Ltd. (TW)

( * ) Notice: Subject to any disclaimer, the term of this patent is extended or adjusted under 35 U.S.C. 154(b) by 159 days.

(21) Appl. No.: 11/223,100

(22) Filed: Sep. 12, 2005

(65) Prior Publication Data

US 2007/0057608 A1 Mar. 15, 2007

(51) Int. Cl.
*A47B 88/00* (2006.01)

(52) U.S. Cl. ..... 312/334.9; 312/334.12; 312/334.13

(58) Field of Classification Search ..... 312/334.6, 312/334.7, 334.8, 334.9, 334.12, 334.13, 312/334.15, 334.16, 334.18, 334.25, 334.26, 312/334.33, 334.36, 334.37, 334.39, 334.45, 312/334.14; 384/18, 19
See application file for complete search history.

(56) References Cited

U.S. PATENT DOCUMENTS 3,897,981 A * 8/1975 Kaplan et al. ..... 384/23
4,351,575 A * 9/1982 Rock et al. ..... 384/18
6,478,393 B2 * 11/2002 Kim et al. ..... 312/334.12
6,682,160 B2 * 1/2004 Kung ..... 312/334.6
7,156,478 B2 * 1/2007 Harn et al. ..... 312/334.6
2004/0000851 A1 * 1/2004 Lam et al. ..... 312/334.7
2004/0227444 A1 * 11/2004 Booker et al. ..... 312/334.45
2005/0231083 A1 * 10/2005 Garcie, Jr. ..... 312/333

FOREIGN PATENT DOCUMENTS

WO 97/31559 * 9/1997
WO 2004/100710 * 11/2004

* cited by examiner

*Primary Examiner*—Janet M. Wilkens

(57) ABSTRACT

An improving structure of adjustable sliding device that can be stretched and shortened in its length, comprises a base, an upper frame, a middle frame and a sliding device. The base further comprises a flat horizontal unit and two side plates which are formed perpendicularly to the flat horizontal unit. One of side plates is a vertical plate formed perpendicularly on one side of the flat horizontal unit and another side plate is a L-shaped plate formed perpendicularly on another side of the flat horizontal unit. The sliding device comprises an upper unit and a bottom unit. A slot is formed at a middle part of the upper unit and the bottom unit, wherein a plurality of horizontal rotating units are located on the upper unit and the bottom unit so that the upper frame, the base and the middle frame can be correspondingly assembled together.

6 Claims, 8 Drawing Sheets

A

STRUCTURE OF ADJUSTABLE SLIDING DEVICE

BACKGROUND OF THE INVENTION

1. Field of Invention

The present invention relates generally to an improving structure of adjustable sliding device. More particularly, the present invention relates to an improving structure of adjustable sliding device that is made of materials with hardness resistance and consists simple assembled components, which reduce the manufacturing costs and simplify the assembled structure.

2. Description of the Related Art

The conventional sliding structure either is utilized in a keyboard sliding pad for a desk computer or in a drawer of a closet. The conventional structure is a sliding structure comprising a plurality of sliding devices with suitable length that wrapped up in several layers. A plurality of rotating wheels are located within the sliding devices, wherein those rotating wheels consisting low friction so that the sliding devices can slide against each other smoothly. The rotating wheels are utilized to vary positions of the sliding devices according to stretched or shorten lengths of the sliding structure. So that the sliding structure can be various its potions so that it can be utilized in a drawer or a keyboard sliding pad.

However, the conventional sliding structure consists other defects as followings:

1. the sliding devices are assembled by wrapped the sliding devices in several layers, as a result, the number of the sliding devices that can be assembled within the layers is restricted. As a matter of fact, the extended length of the sliding devices is limited. Further, due to the assembled method of the conventional sliding structure, the sliding device locating on the outer most layer would subject to the maximum of cross-sectional friction. Thus, the conventional sliding structure is not convenient to be utilized and utilization is restricted.
2. the sliding devices are assembled by wrapped the sliding devices in several layers. The inner most layer of the sliding device would subject to the minimum cross-sectional friction, as a result, ends of the sliding devices of the assembled structure lack of high hardness resistance. Therefore, the utilization of the conventional sliding structure is restricted.
3. due to the design of conventional sliding structure, the sliding devices of the conventional sliding structure are subjected to various different cross-sectional friction. As a result, the sliding devices cannot be interacted correspondingly or its assembled structure cannot be operated smoothly. Thus, the excess components of sliding devices assemblies resulting manufacturing cost and cost of the product management. Therefore, the present invention provides an improving adjustable sliding structure that is free of all the defects of the conventional structure.

SUMMARY OF INVENTION

An improving structure of adjustable sliding device that can be stretched and shortened in its length comprises a base, an upper frame, a middle frame and at least one sliding device. The base comprises a flat horizontal unit and two side plates, which are formed perpendicularly to the flat horizontal unit. The flat horizontal unit is utilized for assembling to a pre-set horizontal surface. One of side plates is a vertical plate formed perpendicularly on one side of the flat horizontal unit and another side plate is a L-shaped plate formed perpendicularly on another side of the flat horizontal unit.

The L-shaped side plate comprises a horizontal plate and a perpendicular plate. At lease one sliding device comprises two sliding units, an upper unit and a bottom unit. A slot is formed at a middle part of the upper unit and the bottom unit. A plurality of horizontal rotating units are located on the upper unit and the bottom unit, wherein the horizontal rotating units are located within the slot and are surrounded by protruding portions of the upper unit. An upper frame has a horizontal unit and two side plates formed perpendicularly to both sides of the horizontal unit respectively. One of the side plates is a perpendicular plate and another is a L-shaped plate. The L-shaped side plate comprises at least one horizontal side plate. A gap is formed in between one of the side plates and the horizontal plate of the L-shaped side plate for locating one sliding device.

At least one middle frame comprises a horizontal unit and two side plates formed perpendicularly to both sides of the horizontal unit respectively. One of the side plates comprises a perpendicular side plate and a horizontal side plate. A gap is formed in between one of the side plates and the horizontal side plate to locate one of sliding devices, wherein the gap is utilized to engage the L-shaped side plate of the base into the middle frame. The horizontal plate of the L-shaped side plate of the base is assembled into the gap of the sliding device locating inside the middle frame. The sliding devices locating between the base and the middle frame are formed correspondingly to each other and can be assembled to form sliding structures sliding smoothly against each other.

The horizontal unit of the middle frame further comprises a L-shaped side plate, which has a perpendicular portion and horizontal portion. The L-shaped side plate is engaged into the gap of the upper frame, wherein the horizontal portion of the L-shaped side plate is engaged into the gap of the sliding device locating inside the upper frame, wherein the sliding devices locating inside the upper frame. The middle frame and the base are utilized to assembled between the upper frame, the base and the middle frame to form sliding assemblies.

It is an object of the present invention to provide an improving structure of adjustable sliding device that can be increased its lengths of the base and the upper frame by utilizing a plurality of middle frames. It is another object of the present invention to provide an improving structure of adjustable sliding device that comprises simple and few assembled components. In other words, the present invention provides an improving design that can reduce the manufacturing cost and the cost of the management of product control.

Both the foregoing general description and the following detailed description are exemplary and explanatory only and are restrictive of the invention, as claimed.

BRIEF DESCRIPTION OF THE DRAWINGS

The accompanying drawings are included to provide a further understanding of the present invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
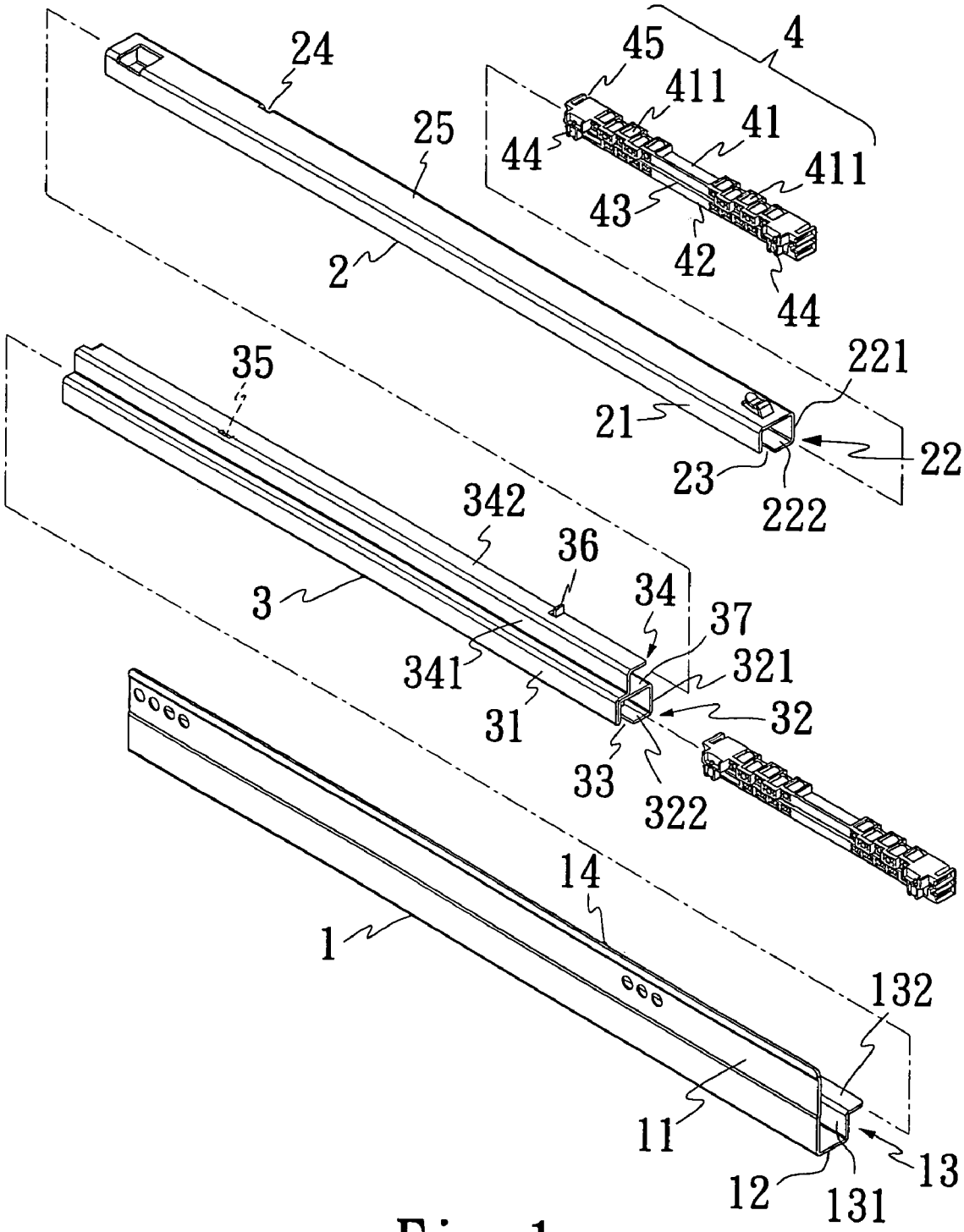
FIG. 1 is an assembled view of an improving structure of adjustable sliding device in accordance with a preferred example of the present invention.
Figure 2:
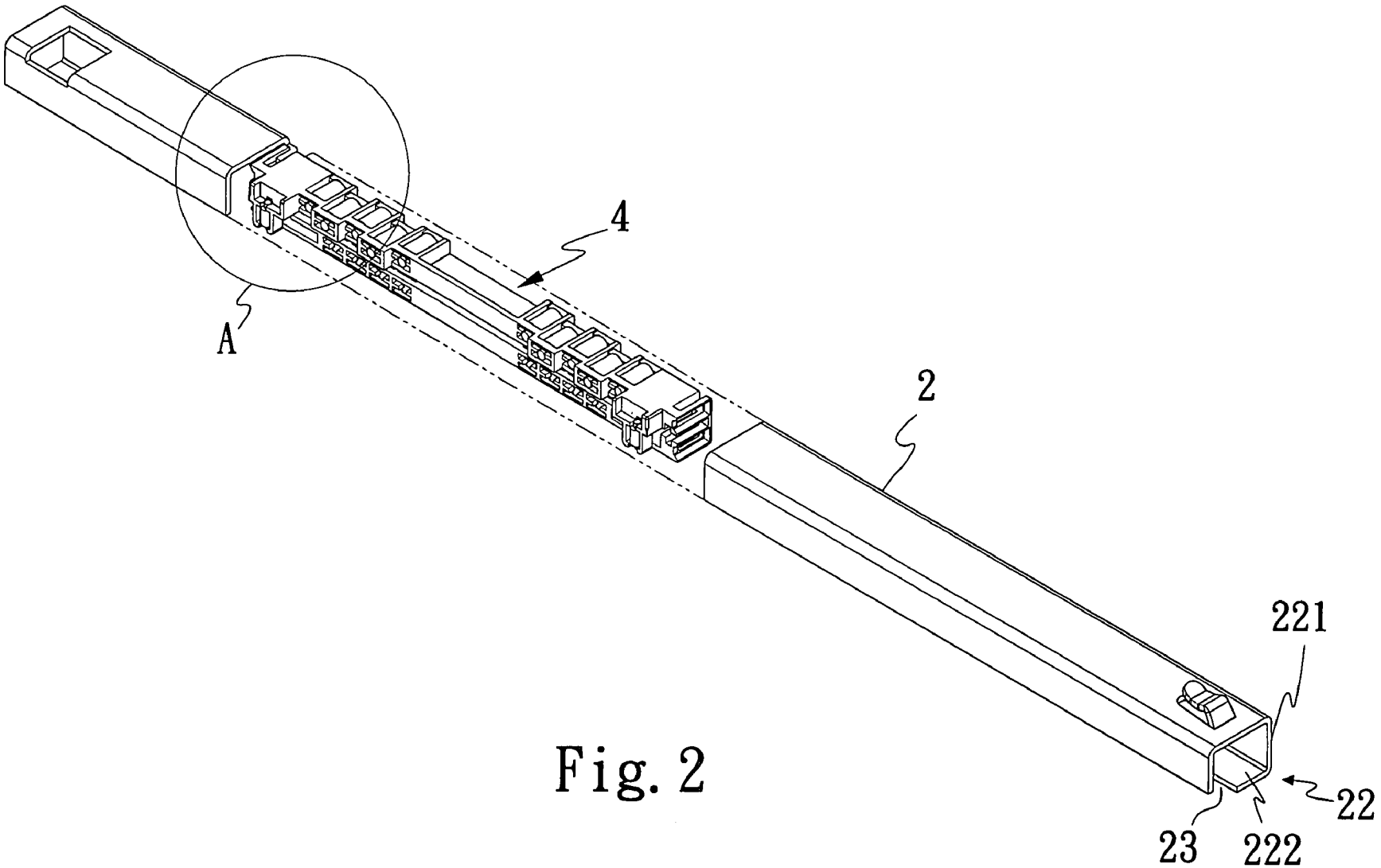
FIG. 2 is a 3-D view of a completed assembled structure of an adjustable sliding device in accordance with a preferred example of the present invention.
Figure 3:
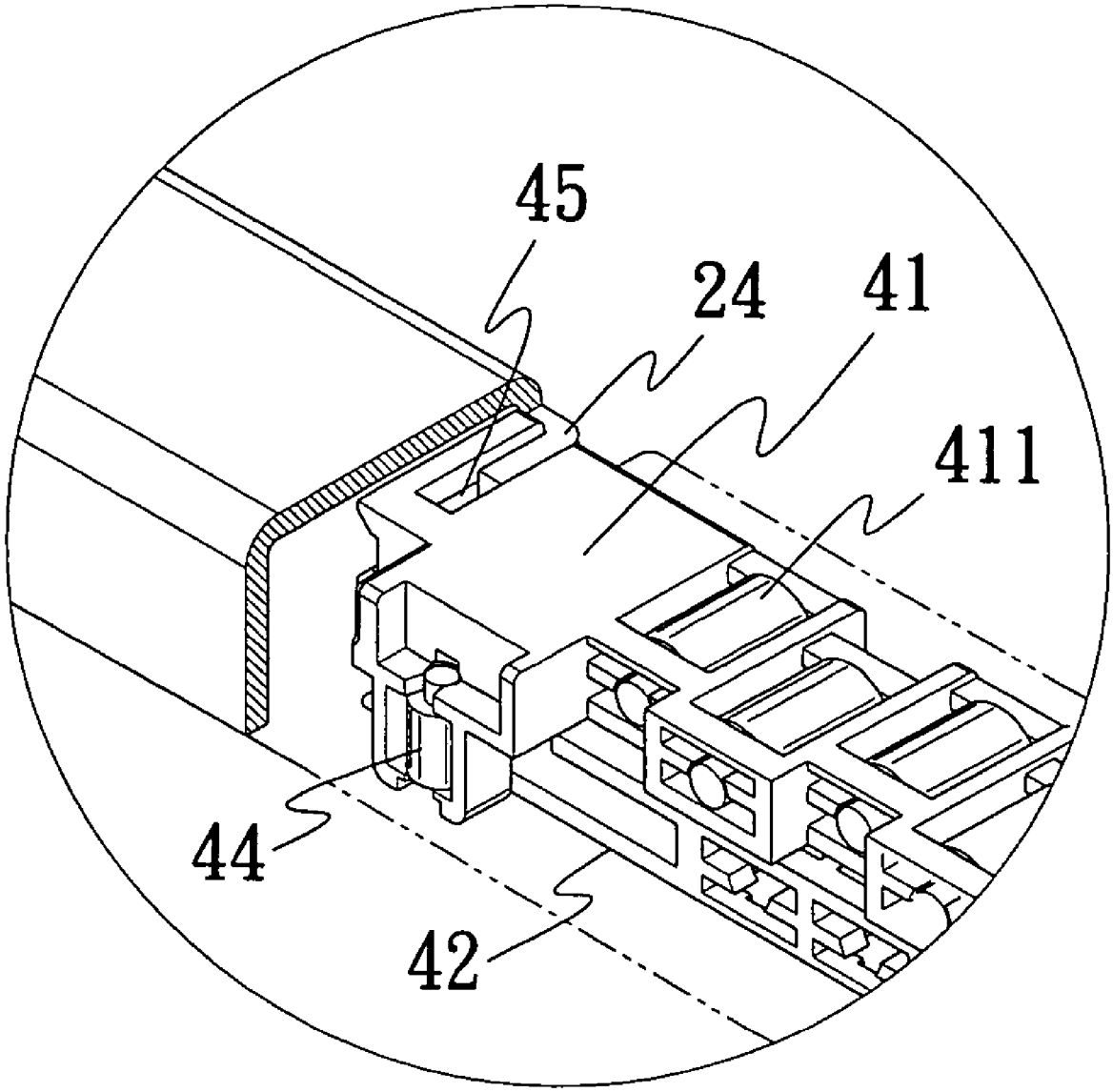
FIG. 3 is a partial view of a assembled structure of the adjustable sliding device on FIG. 2.
Figure 4:
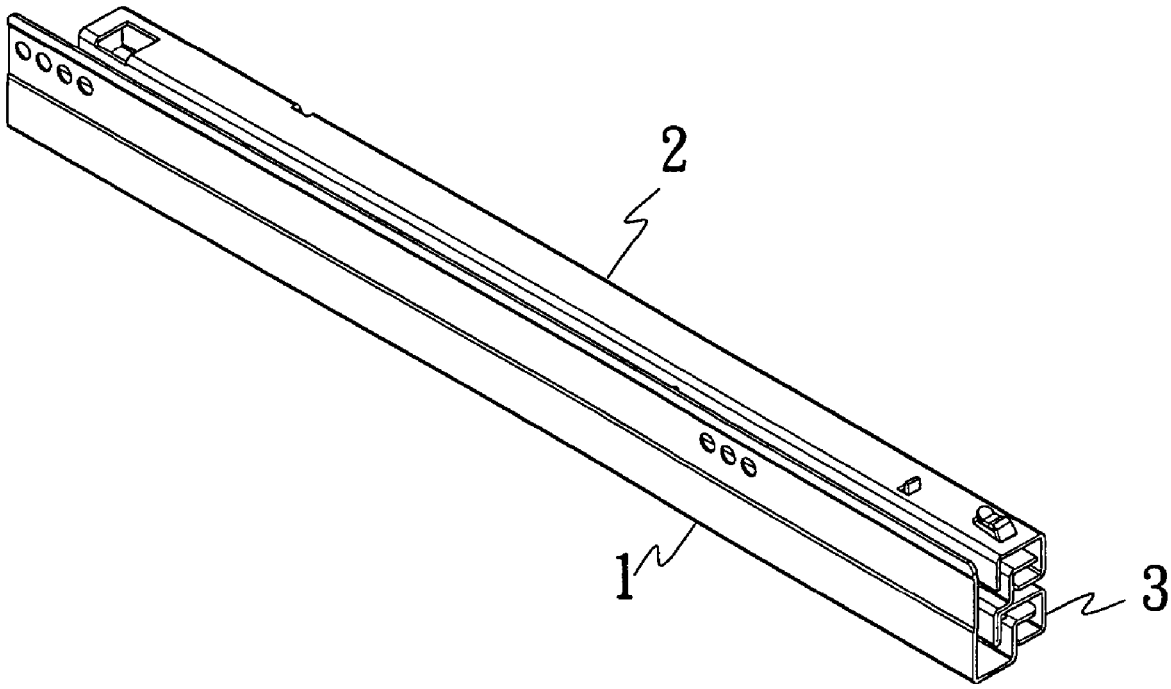
FIG. 4 is an outer view of the completed assembled structure of the adjustable sliding device in accordance with the preferred example of the present invention.
Figure 5:
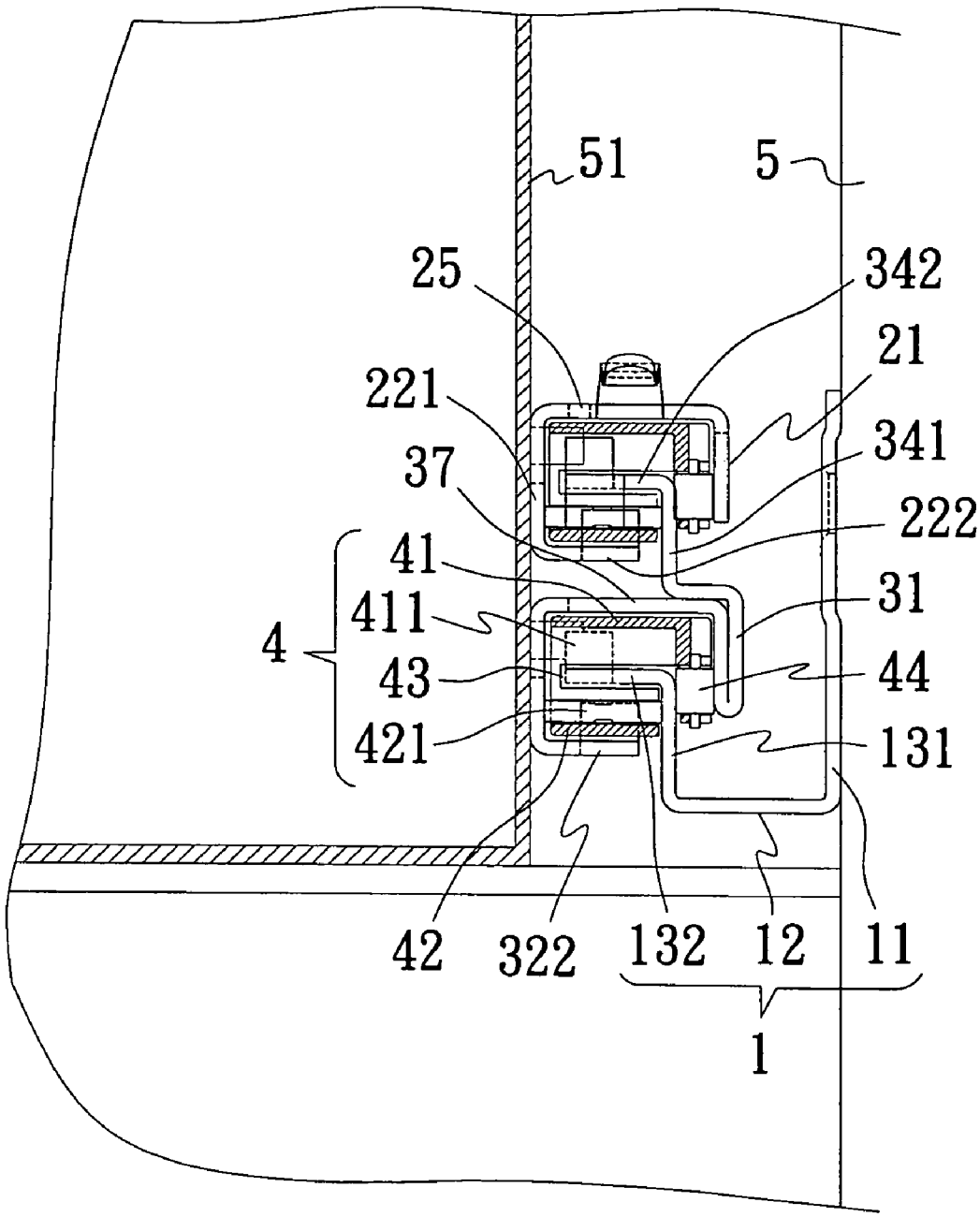
FIG. 5 is a partial cross-sectional view of the assembled structure of the adjustable sliding device in accordance with the preferred example of the present invention.

FIG. 1 illustrates an assembled view of an improving structure of adjustable sliding device in accordance with a preferred example of the present invention. Refer to FIGS. 2-5, from the drawings, it is clear to notice that the improving structure of adjustable sliding device comprises a base 1, an upper frame 2, a middle frame 3 and a sliding device 4, wherein the base is a rectangular shaped body and has a flat surface horizontal unit 12. Two side plates 11 and 13 are formed perpendicularly to the flat surface horizontal unit 12, wherein the perpendicular plate 11 is a vertical plate formed perpendicularly to one side of the horizontal unit 12 and the side plate 13 is a L-shaped plate on an opposite side of the perpendicular plate 11. The L-shaped side plate 13 is formed perpendicularly to the horizontal unit 12. The L-shaped side plate 13 comprises a vertical plate 131 and a horizontal plate 132. A protecting screen 14 is protruded from a middle part of the horizontal plate 132.

The upper frame 2 is a rectangular body and comprises a horizontal unit 25, two side plates 21 and 22 formed perpendicularly to both sides of the horizontal unit 25 respectively. Wherein the perpendicular plate 21 is a straight plate 21 and the side plate 22 is a L-shaped plate. The L-shaped side plate 22 consists of a perpendicular side plate 221 and a horizontal portion 222. A gap 23 is formed in between the straight perpendicular plate 21 and the horizontal portion 222 of the L-shaped side plate 22. A protruding unit 24 is formed into a L-shaped plate at one part of perpendicular side plate 221 of the L-shaped side plate 22. The middle frame 3 comprises similar structures as the upper frame 2.

The middle frame 3 comprises a horizontal unit 37, two side plates 31 and 32 formed perpendicularly to both sides of the horizontal unit 37 respectively. Wherein the perpendicular plate 31 is a straight plate and the side plate 32 is a L-shaped plate. The L-shaped side plate 32 consists of a perpendicular side plate 321 and a horizontal portion 322. A gap 33 is formed in between the straight perpendicular plate 31 and the horizontal portion 322 of the L-shaped side plate 32. A L-shaped plate 34 is formed on middle portion of the horizontal unit 37, wherein the L-shaped plate 34 consists of a perpendicular side plate 341 and a horizontal portion 342. A protruding unit 35 is formed into a L-shaped plate at one side of the L-shaped side plate 32 of the middle frame 3.

A protecting screen 36 is protruded from one side of the horizontal portion 342. The sliding device 4 comprises two rectangular-shaped units, an upper unit 41 and a bottom unit 42. A slot 43 is formed at a middle part of the upper unit 41 and the bottom unit 42. A plurality of horizontal rotating units 411 and 421 are located on the sliding device 4, wherein the horizontal rotating units 411 are located within the slot 43 and are surrounded by protruding portions of the upper unit 41. The horizontal rotating units 421 are located within the slots 43 and are surrounded by protruding portions of the bottom unit 42. Refer to FIG. 1, a plurality of rotating units 44 are formed and located perpendicularly to the slot 43. A fixing slot 45 is formed at one end of the sliding device 4.

In assembling, the sliding device 4 is assembled onto between the horizontal portion 222 of the L-shaped side plate 22 and the horizontal unit 25 of the upper frame 2, and the horizontal portion 322 of the L-shaped side plate 32 and the horizontal unit 37 of the middle frame 3. The sliding device 4 is fixed onto the upper frame 2 and the middle frame 3 by utilizing the protruding unit 24 of the of the upper frame 2 and the protruding unit 35 of the middle frame 3 to engage firmly into the fixing slot 45 of the sliding device 4. The L-shaped side plate 13 of the base 1 is engaged into the gap 33 of the middle frame 3 so that the horizontal plate 132 of the L-shaped side plate 13 is inserted into the slot 43 of the sliding device 4 locating inside the middle frame 3.

The horizontal rotating units 411 of the sliding device 4 are assembled to able to move along in between the horizontal plate 132 of the base 1 and the horizontal unit 37 of the middle frame 3. The horizontal rotating units 421 of the sliding device 4 are also assembled to move along in between the horizontal portion 322 of the middle frame 3 and the horizontal plate 132 of the base 1. Thus, the base 1 and the middle frame 3 are assembled respectively to form corresponding structures that can slide smoothly against each other. The L-shaped plate 34 of the middle frame 3 is engaged into the gap 23 of the middle frame 2. The horizontal portion 342 of the upper frame 2 is attached to the slot 43 of the sliding device 4.

The horizontal rotating units 411 of the sliding device 4 rotate along the horizontal portion 342 of the middle frame 3 and the horizontal unit 25 of the upper frame 2, wherein the horizontal rotating units 421 of the sliding device 4 rotate along the horizontal portion 342 of the middle frame 3 and the horizontal portion 222 of the upper frame 2. The rotating units 44 rotates along the perpendicular plate 21 of the upper frame 2 and the perpendicular side plate 341 of the middle frame 3 so that the middle frame 3 and the upper frame 2 are assembled respectively to form corresponding structures that can slide smoothly against each other.

The above-mentioned base 1, the upper frame 2 and the middle frame 3 and the sliding device 4 are assembled together so that the perpendicular plate 11 of the base 1 is fixed onto walls of an empty space of a closet 5, and the perpendicular side plate 221 of the upper frame 2 is corresponding and engaged to an outer side surface of a drawer 51 (or a sliding keyboard).

Figure 6:
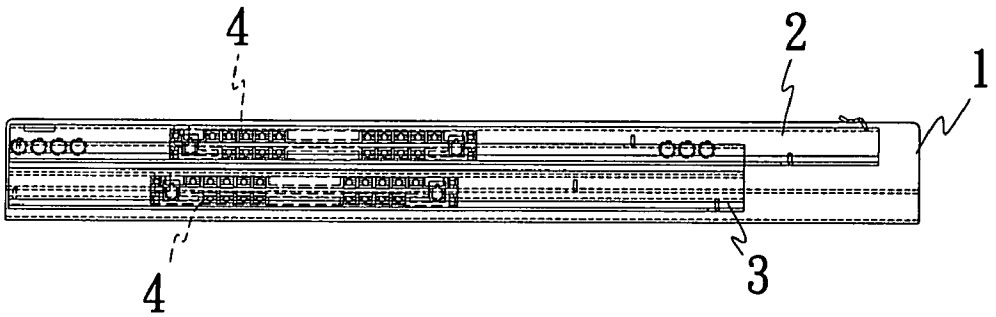
FIG. 6 is a view of showing an assembled adjustable sliding device in accordance with a preferred example of the present invention.
Figure 7:
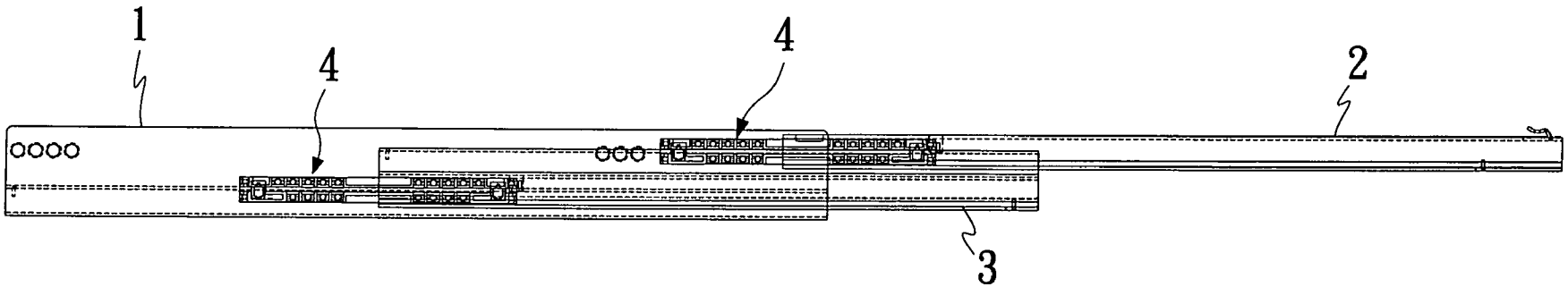
FIG. 7 is a view of illustrating when the assembled adjustable sliding device is in a stretched position

FIG. 6 is a view of showing an assembled adjustable sliding device in accordance with a preferred example of the present invention. FIG. 7 is a view of illustrating when the assembled adjustable sliding device is in a stretched position. In a closed position as shown in the FIG. 6, the base 1, the middle frame 3 and the upper frame 2 are respectively staked onto to each other. In the stretched position as shown in FIG. 7, the upper frame 2 is pull out from the assembled sliding device 4 until it is stopped by the protecting screen 36 locating at the middle part of the middle frame 3. The middle frame 3 is moved along the upper frame 2 in an outward direction until the protecting screen 14 of the base 1 stops the sliding device 4 locating inside the middle frame 3. So that a the sliding device is in a completed stretched position as shown in FIG. 7.

Figure 8:
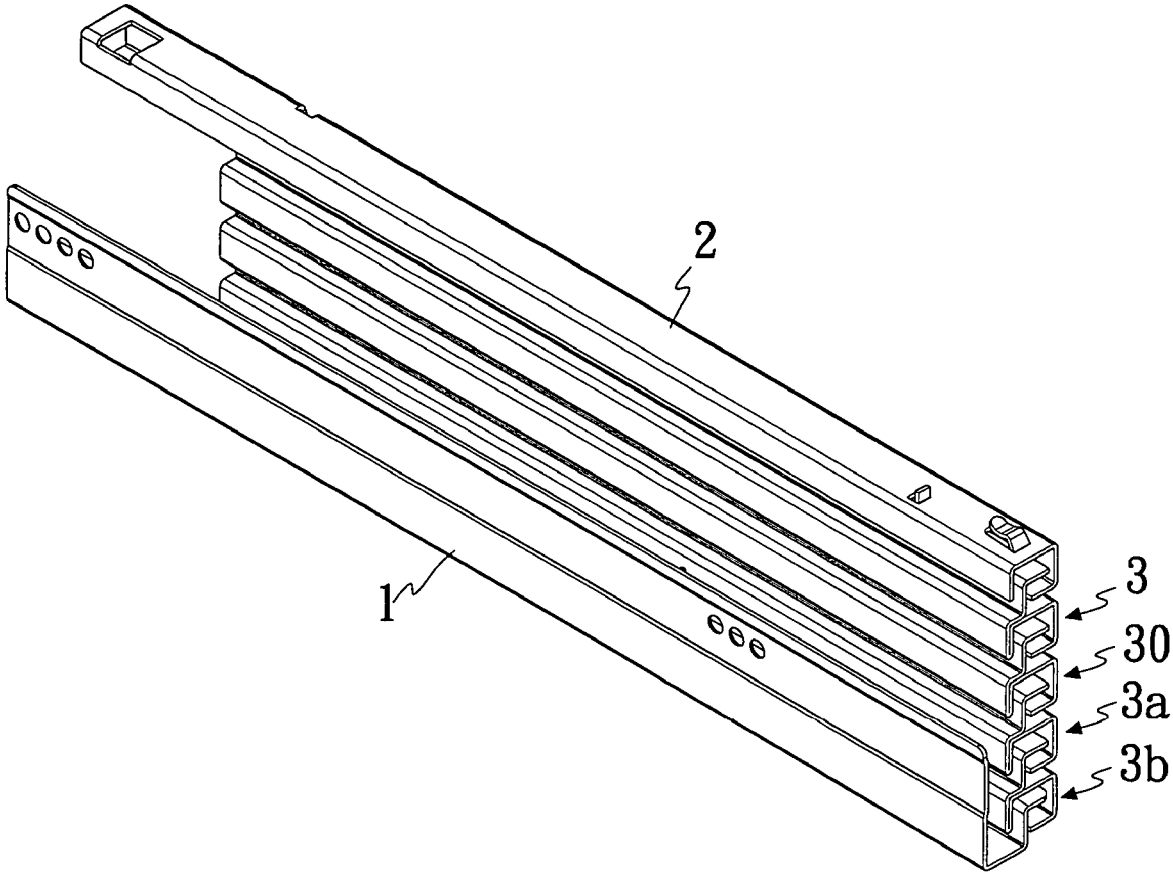
FIG. 8 shows 3-D view of an assembled adjustable sliding device in accordance with a preferred example of the present invention.
Figure 9:
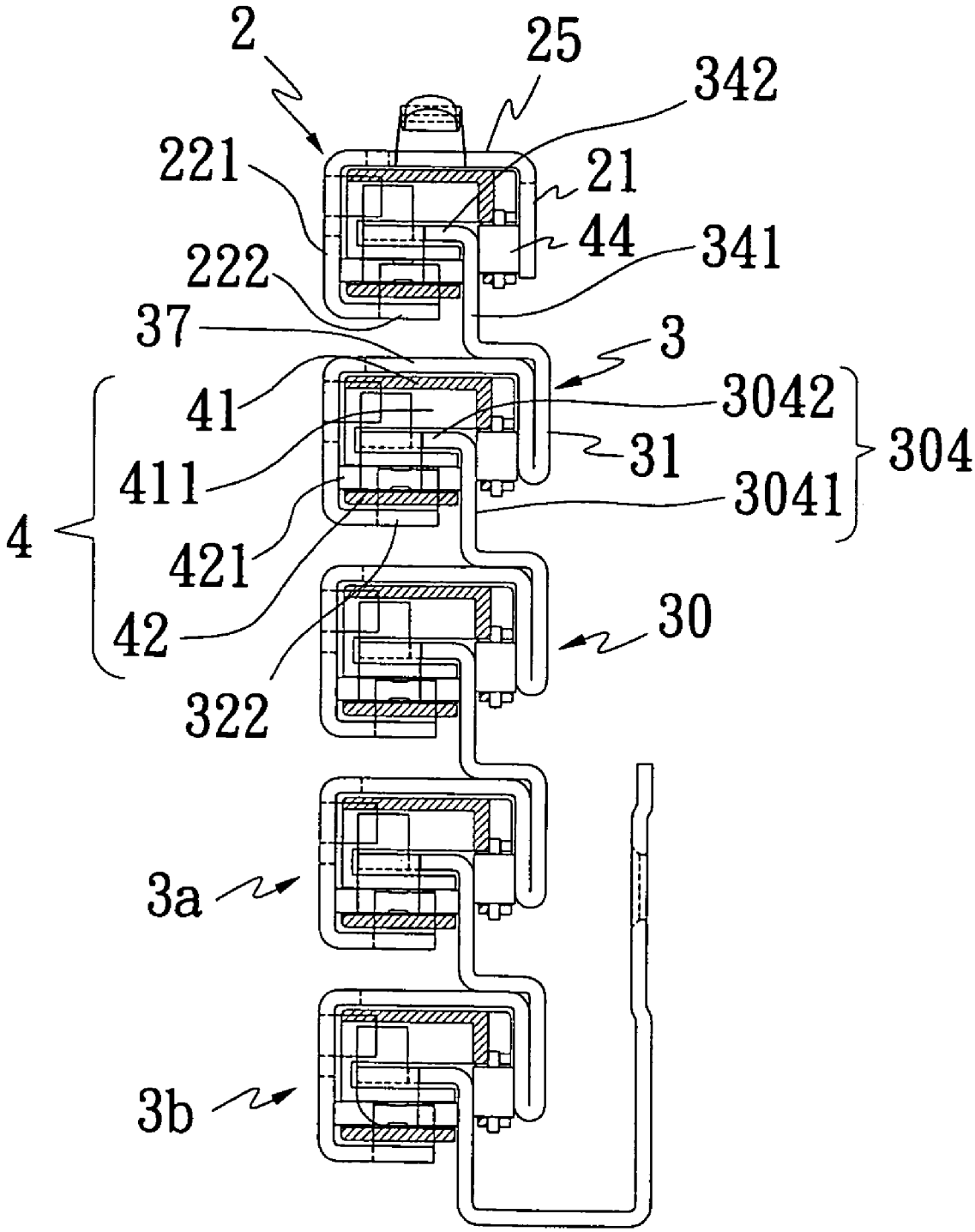
FIG. 9 illustrates a cross-sectional view of the assembled adjustable sliding device in FIG. 8

FIGS. 8 and 9 show 3-D views of an assembled adjustable sliding device in accordance with a preferred example of the present invention. Refer to FIGS. 8 and 9, where the adjustable sliding device of the present invention comprises a base 1, an upper frame 2 and a plurality of middle frames staking over to each other 3, 30, 3*a* and 3*b*. Take the staking structure of 3 and 30 as an example, a hooking portion 304 of the middle frame 30 is engaged with the gap 33 of the middle frame 3. A horizontal plate 3042 is engaged into the slot 43 of the sliding device 4 locating at a middle part of the horizontal unit 37 and the horizontal portion 322. The horizontal rotating units 411 of the sliding device 4 slide in between the horizontal plate 3042 of the middle frame 30 and the horizontal unit 37. The horizontal rotating units 421 of the sliding device 4 slide in between the horizontal plate 3042 of the middle frame 30 and the horizontal portion 322. The rotating units 44 slide in between the perpendicular plate 31 of the middle frame 3 and a perpendicular side plate 3041 of the middle frame 30. As a result, the two middle frames 3 and 30 can slide against each other smoothly. A top portion of the middle frame 3 and the upper frame 2 is assembled together, wherein the middle frame 3*b* is assembled with the base 1 to form a sliding device that can be stretched and shortened of its length.

The forgoing is considered illustrative of the principles of the invention. As variations and related embodiments may occur to those skilled in the art, it is to be appreciated the invention, and all suitable modifications and equivalents, are only to be limited by the scope of the claims following hereinafter.

What is claimed is:

1. An improving structure of adjustable sliding device that can be stretched and shortened in its length, comprising:

a base, having a flat horizontal unit and two side plates which are formed perpendicularly to the flat horizontal unit, the flat horizontal unit is utilized for assembling to a pre-set horizontal surface, one of side plates is a vertical plate formed perpendicularly on one side of the flat horizontal unit and another side plate is a L-shaped plate formed perpendicularly on another side of the flat horizontal unit, wherein the L-shaped side plate comprises a horizontal plate and a perpendicular plate;

a plurality of sliding devices, having two sliding units, an upper unit and a bottom unit, a slot is formed at a middle part of the upper unit and the bottom unit, a plurality of horizontal rotating units are located on the upper unit and the bottom unit, wherein the horizontal rotating units are located within the slot and are surrounded by protruding portions of the upper unit;

an upper frame, having a horizontal unit and two side plates formed perpendicularly to both sides of the horizontal unit respectively, wherein one of the side plates is a perpendicular plate and another is a L-shaped plate, the L-shaped side plate comprises at least one horizontal side plate, a gap is formed in between one of the side plates and the horizontal plate of the L-shaped side plate for locating one sliding device; and at least one middle frame, having a horizontal unit and two side plates formed perpendicularly to both sides of the horizontal unit respectively, wherein one of the side plates comprises a perpendicular side plate and a horizontal side plate, a gap is formed in between one of the side plates and the horizontal side plate to locate one of sliding devices, the gap is utilized to engage the L-shaped side plate of the base into the middle frame, the horizontal plate of the L-shaped side plate of the base is assembled into the gap of the sliding device locating inside the middle frame, the sliding devices locating between the base and the middle frame to form corresponding assembled sliding structures that can slide smoothly against each other, the horizontal unit of the middle frame further comprising a L-shaped side plate having a perpendicular portion and horizontal portion, the L-shaped side plate is engaged into the gap of the upper frame, wherein the horizontal portion of the L-shaped side plate is engaged into the gap of the sliding device locating inside the upper frame, wherein the sliding devices locating inside the upper frame, the middle frame and the base are utilized to assembled between the upper frame, the base and the middle frame to form sliding assemblies.

2. The improving structure of claim 1, wherein a plurality of the horizontal rotating units are formed in between gaps of the sliding assemblies, the horizontal rotating units can be utilized to support one of side plates of the upper frame and the perpendicular side plate of the middle frame, or to support the one of side plates of the middle frame and the perpendicular plate of the base so that the sliding devices can move smoothly along the base, the upper frame and the middle frame.

3. The improving structure of the claim 1, wherein at least one fixing slot is formed at one end of the sliding devices, the sliding devices are fixed onto the upper frame and the middle frame by utilizing a protruding unit of the of the upper frame and a protruding unit of the middle frame to engage firmly into the fixing slot of the sliding devices.

4. The improving structure of the claim 1, wherein a protecting screen is protruded from one side of the horizontal side plate of the middle frame, and a protecting screen is also formed at a middle part of the horizontal plate of the base, the protecting screens are utilized to set a sliding area of the sliding devices.

5. The improving structure of claim 1, wherein a plurality of the middle frames locating in between the base and the upper frame, the middle frames are assembled together by a stacking method so that the base or the upper frame of the sliding devices can be extended its length.

6. The improving structure of claim 5, wherein a L-shaped plate of a first middle frame of the plurality of middle frames is engaged into a gap of a second middle frame, wherein a horizontal side plate of the first middle frame is engaged into the gap of the sliding device locating inside the second middle frame, so that the plurality of middle frames can be stacked together to form an assembled structure.

* * * * *